US009387659B2

(12) United States Patent
Rondon et al.

(10) Patent No.: US 9,387,659 B2
(45) **Date of Patent: *Jul. 12, 2016**

(54) ABLATION-TYPE LITHOGRAPHIC PRINTING MEMBERS HAVING IMPROVED EXPOSURE SENSITIVITY AND RELATED METHODS

(75) Inventors: Sonia Rondon, Nashua, NH (US); Kevin Ray, Windham, NH (US)

(73) Assignee: Presstek, LLC, Hudson, NH (US)

( * ) Notice: Subject to any disclaimer, the term of this patent is extended or adjusted under 35 U.S.C. 154(b) by 836 days.

This patent is subject to a terminal disclaimer.

(21) Appl. No.: 13/295,300

(22) Filed: Nov. 14, 2011

(65) Prior Publication Data

US 2012/0291644 A1 Nov. 22, 2012

Related U.S. Application Data

(63) Continuation-in-part of application No. 13/109,651, filed on May 17, 2011.

(51) Int. Cl.

| | |
|---|---|
| ***B41N 1/08*** | (2006.01) |
| ***B41C 1/10*** | (2006.01) |
| *B41N 1/00* | (2006.01) |

(52) U.S. Cl.

CPC ..... *B41C 1/1033* (2013.01); *B41C 2201/02* (2013.01); *B41C 2210/262* (2013.01); *B41N 1/003* (2013.01)

(58) Field of Classification Search

None

See application file for complete search history.

(56) References Cited

U.S. PATENT DOCUMENTS

| | | | |
|---|---|---|---|
| 5,339,737 | A | 8/1994 | Lewis et al. |
| 6,194,122 | B1 | 2/2001 | Ichikawa et al. |
| 6,344,306 | B1 | 2/2002 | Fujiyoshi et al. |
| 6,576,399 | B1 | 6/2003 | Gries et al. |
| 8,967,043 | B2 | 3/2015 | Rondon et al. |
| 2001/0026902 | A1 | 10/2001 | Hirano et al. |
| 2004/0005514 | A1 | 1/2004 | Saraiya et al. |
| 2004/0224256 | A1 | 11/2004 | Figov |
| 2009/0253069 | A1 | 10/2009 | Melamed et al. |
| 2009/0305162 | A1 | 12/2009 | Melamed et al. |
| 2012/0055363 | A1 | 3/2012 | Danzinger et al. |
| 2012/0291643 | A1 | 11/2012 | Rondon et al. |
| 2012/0291645 | A1 | 11/2012 | Rondon et al. |
| 2012/0312183 | A1 | 12/2012 | Rondon et al. |

FOREIGN PATENT DOCUMENTS

| | | | |
|---|---|---|---|
| EP | 1788431 | A2 | 5/2007 |
| EP | 2425985 | A2 | 3/2012 |
| EP | 2709846 | A1 | 3/2014 |
| WO | 2012/158318 | A1 | 11/2012 |
| WO | 2014/031828 | A1 | 2/2014 |

OTHER PUBLICATIONS

Allnex Product Guide. www.allnex.com. Retrieved Jun. 2, 2014.*

(Continued)

*Primary Examiner* — Joshua D Zimmerman

(74) *Attorney, Agent, or Firm* — Morgan, Lewis & Bockius LLP

(57) ABSTRACT

Ablation-type printing plates having improved exposure sensitivity are produced using a thin imaging layer—i.e., the plate layer that absorbs and ablates in response to imaging radiation—whose composition includes a large proportion of radiation absorber.

32 Claims, 1 Drawing Sheet

(56) References Cited

OTHER PUBLICATIONS

International Search Report and Written Opionion mailed Aug. 6, 2012 for International Application No. PCT/US2011/73065560 (10 pages).
Written Opionion mailed Nov. 19, 2013 for International Application No. PCT/US2012/034879 (6 pages).
Crosslinkers, Allnex A., "Amino Crosslinkers", Allnex CYMEL Product Guide, 2014, pp. 1-19.
Holmberg, Krister, "Low Temperature Acid Catalyzed Curing of Melamine Resin Systems", Polymer Bulletin, vol. 11, 1984, pp. 81-84.
Porwal, Harshad, "Cytec Cymel Resins", Cytec CYMEL Product Guide, 2010, p. 1-8.
PCT International Patent Application No. PCT/US2012/034879, International Preliminary Report on Patentability mailed Nov. 28, 2013, 8 pages.
PCT International Patent Application No. PCT/US2013/056139, International Preliminary Report on Patentability mailed Mar. 5, 2015, 8 pages.
PCT International Patent Application No. PCT/US2013/056139, International Search Report and Written Opinion mailed Jan. 20, 2014, 10 pages.

* cited by examiner

ABLATION-TYPE LITHOGRAPHIC PRINTING MEMBERS HAVING IMPROVED EXPOSURE SENSITIVITY AND RELATED METHODS

RELATED APPLICATION

This is a continuation-in-part of U.S. Ser. No. 13/109,651, filed on May 17, 2011, the entire disclosure of which is hereby incorporated by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems frequently rely on removal of an energy-absorbing layer from the lithographic plate to create an image. Exposure to laser radiation (typically in the near-infrared (IR) range) may, for example, cause ablation—i.e., catastrophic overheating—of the ablated layer in order to facilitate its removal. Because ablation produces airborne debris, ablation-type plates must be designed with imaging byproducts in mind; for example, the plate may be designed so as to trap ablation debris between layers, at least one of which is not removed until after imaging is complete.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially) by a post-imaging cleaning process—e.g., rubbing of the plate with or without a cleaning liquid—to reveal the third layer (typically an oleophilic polymer, such as polyester).

The commercial viability of any printing system depends critically on the speed at which a printing plate can be imaged, and secondarily on the required laser power. These two parameters are intimately related, as higher laser power results in greater beam fluence, delivering a greater quantity of energy with each imaging pulse. Within limits, higher beam fluence levels increase the rate at which ablation takes place, so that imaging can be carried out at faster speeds—that is, each imaging pulse can be of shorter duration, so the plate can be imaged more quickly.

The relationship between laser power and imaging speed is not strictly inverse, however, and increasing laser power soon leads to diminishing returns, as the responsiveness of the plate imaging layer is constrained by physico-chemical characteristics that limit the rate at which ablation can take place. Moreover, high-power lasers are expensive both to procure and to operate, and can cause damage to the plate beyond the intended results of ablation. Accordingly, increases in imaging speed are desirably realized through improvements in plate characteristics. Such improvements are not easily achieved, however, because increasing exposure sensitivity typically degrades the durability of the plate. For example, sensitivity can be improved by thinning the plate layers or increasing the loading level of an IR-absorbing material, but the result is a more delicate plate structure.

SUMMARY OF THE INVENTION

As explained in the '651 parent application, it has been found, surprisingly, that plates having improved exposure sensitivity can be produced using an imaging layer—i.e., the plate layer that absorbs and ablates in response to imaging radiation—whose composition includes a large proportion of melamine resin crosslinker. It has further been discovered, also surprisingly, that for printing members having polymer (typically polyester) substrates, increasing the proportion of the IR absorber while reducing the dry coating weight of the imaging layer leads to greater responsiveness to imaging radiation. Performance remains strong even when the printing member is machine-cleaned.

In a typical matrix for a polymeric imaging layer, the "binder" resin predominates (typically at levels in the 70% range) and the crosslinker is present at a much lower level (e.g., in the 10% range). Imaging-layer compositions in accordance with the present invention achieve improved speed with good durability at much higher levels of crosslinker, e.g., on the order of 80% or more of the composition in some embodiments. For example, whereas a prior-art composition based on a resole resin might contain 12 to 25% IR-absorptive dye, 15% melamine crosslinker, 0.7 to 4.8% sulfonic acid catalyst, and 70% resole resin, a corresponding formulation in accordance herewith may contain 20 to 30% IR-absorptive dye, 65-80% melamine crosslinker, 0.7 to 4.8% sulfonic acid catalyst, and less than 25% (and as little as zero) resole resin. The term "resole resin" refers to the reaction of phenol with an aldehyde (usually formaldehyde) under alkali conditions with an excess of formaldehyde. The molar ratio of phenol to aldehyde is typically 1:1.1 to 1:3, and the excess formaldehyde causes the resulting polymer to have many $CH_2OH$ (methylol) pendant groups. This distinguishes resoles from other phenolic resins (including phenol formaldehyde resins such as novolaks, which are prepared under acidic conditions with an excess of phenol rather than aldehyde).

Without being bound to any particular theory or mechanism, it is hypothesized that, after exposure, the ablation debris generated in a plate in accordance with the present invention is water compatible or otherwise easier to remove during cleaning, resulting in the ability to tolerate less complete ablation and, consequently, faster imaging at a given fluence level. It is also found that the curing temperature of the imaging layer during plate manufacture can be important to plate performance, since too much heat during curing compromises the sensitivity of the finished plate while inadequate heat leads to incomplete cure and consequent plate instability. Curing temperatures ranging from 220 to 320° F., and especially 240 to 280° F., have been used to advantage.

performed manually (e.g., dry rubbing the imaged plate with a cotton towel followed by wet rubbing with a cotton towel saturated with isopropanol). A printing member having an imaging layer coated at 0.5 g/m$^2$, for example, will receive ink on-press satisfactorily after correct exposure and subsequent hand cleaning. But hand cleaning requires an experienced practitioner, can damage the non-image oleophobic regions of the plate, and can lead to inconsistent results.

In various embodiments, the method comprises providing a printing member that itself comprises an oleophilic, polymeric first layer; an oleophilic imaging layer disposed over the first layer; and an oleophobic third layer disposed over the imaging layer. The imaging layer may comprise or consist essentially of a cured resin phase consisting essentially of a melamine resin and a resole resin, the resole resin being present in an amount ranging from 0% to 28% by weight of dry film, and, dispersed within the cured resin phase, a near-IR absorber present in an amount ranging from 20% to 30% by weight of dry film; in various embodiments, the imaging layer has a dry coating weight of not more than 0.5 g/m$^2$. The printing member is exposed to imaging radiation in an imagewise pattern, and the imaging radiation at least partially ablates the imaging layer where exposed. Following imaging, the printing member is subjected to machine cleaning (e.g., spray-on cleaning) to remove the third layer and at least a portion of the imaging layer where the printing member received imaging radiation, thereby creating an imagewise pattern on the printing member. Because the imaging layer is oleophilic it need not be fully removed, which permits fast operation with low-power lasers and large imaging-layer thicknesses, which are found to be beneficial to post-cleaning performance.

The printing member is usually exposed at a fluence not exceeding 195 mJ/cm$^2$, which is sufficient to resolve high-resolution patterns such as 2×2 screens and single pixel lines. The oleophilic first layer may be a polymer (e.g., polyester) sheet, and the cured resin phase of the printing member preferably contains no resole resin. The near-IR absorber may be a near-IR absorbing dye, and the third layer is typically silicone.

The near-IR absorber may constitute no less than 25% of the imaging layer by weight of dry film, and the melamine resin may constitute no more than 88% of the imaging layer by weight. For example, the melamine resin may be a methylated, low-methylol, high-imino melamine and/or may have a viscosity ranging from 1000 to 1600 centipoises at 23° C. The imaging layer may have a dry coating weight of approximately 0.5 g/m$^2$.

The cleaning fluid may be an aqueous liquid, e.g., plain tap water. In some embodiments, the aqueous liquid comprises water and a component that eases the removal of silicone. For example, the aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant. It may be heated to a temperature greater than about 80° F. The machine cleaning may be spray-on cleaning, e.g., using oscillating brush rollers.

In a second aspect, the invention pertains to a printing member. Embodiments thereof include an oleophilic, polymeric (e.g., polyester) first layer; an oleophilic imaging layer disposed over the first layer; and an oleophobic third layer disposed over the imaging layer. The imaging layer may have a cured resin phase consisting essentially of a melamine resin and a resole resin, the latter present in an amount ranging from 0% to 28% by weight of dry film. Dispersed within the cured resin phase is a near-IR absorber (e.g., a dye) that may be present in an amount ranging from 20% to 30% by weight of dry film. The dry coating weight of the imaging layer may be no more than 0.5 g/m$^2$.

In various embodiments, the near-IR absorber constitutes no less than 25% of the imaging layer by weight of dry film, and the melamine resin may constitute no more than 88% of the imaging layer by weight; e.g., the melamine resin may be a methylated, low-methylol, high-imino melamine, and may have a viscosity ranging from 1000 to 1600 centipoises at 23° C.

In a third aspect, the invention pertains to a method of making an ablation-type printing member. In various embodiments, the method comprises providing a precursor structure having a polymeric, oleophilic surface. An oleophilic resin composition is coated over the precursor structure and cured. The resin composition may have a cured resin phase consisting essentially of a melamine resin and a resole resin, where the resole resin is present in an amount ranging from 0% to 28% by weight of dry film, and a dry coating weight of not more than 0.5 g/m$^2$. A near-IR absorber, present in an amount ranging from 20% to 30% by weight of dry film, may be dispersed, prior to curing, within the resin phase. After the resin composition is cured, an oleophobic polymer composition is coated thereover and cured. In various embodiments, the resin composition is cured at a temperature ranging from 220 to 320° F., e.g., from 240 to 280° F.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The terms "substantially" and "approximately" mean±10% (e.g., by weight or by volume), and in some embodiments, ±5%. The term "consists essentially of" means excluding other materials that contribute to function or structure. For example, a resin phase consisting essentially of a melamine resin and a resole resin may include other ingredients, such as a catalyst, that may perform important functions but do not constitute part of the polymer structure of the resin. Percentages refer to weight percentages unless otherwise indicated.

DESCRIPTION OF DRAWINGS

In the following description, various embodiments of the present invention are described with reference to FIGS. 1A and 1B, which show enlarged cross-sectional views of printing members according to the invention.

DETAILED DESCRIPTION

1. Printing Plates

Figure 1A:
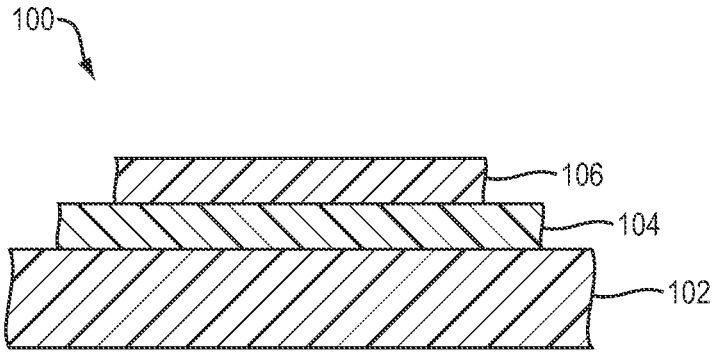

FIG. 1A illustrates a negative-working printing member 100 according to the present invention that includes a polymeric substrate 102, an imaging layer 104, and a topmost layer 106. Layer 104 is sensitive to imaging (generally IR) radiation as discussed below, and imaging of the printing member 100 (by exposure to IR radiation) results in imagewise ablation of the layer 104. The resulting de-anchorage of topmost layer 106 facilitates its removal by rubbing or simply as a result of contact during the print "make ready" process. Preferably, the ablation debris of layer 104 is chemically compatible with water in the sense of being acted upon, and removed by, an aqueous liquid following imaging. Substrate 102 (or a layer thereover) exhibits a lithographic affinity opposite that of topmost layer 106. Consequently, ablation of layer 104, followed by imagewise removal of the layer 106 to reveal an underlying layer or the substrate 102, results in a lithographic image.

Most of the films used in the present invention are "continuous" in the sense that the underlying surface is completely covered with a uniform layer of the deposited material. Each of these layers and their functions is described in detail below.

1.1 Layer 102

When serving as a substrate, layer 102 provides dimensionally stable mechanical support to the printing member. The substrate should be strong, stable, and flexible. One or more surfaces (and, in some cases, bulk components) of the substrate may be hydrophilic. The topmost surface, however, is generally oleophilic. Suitable materials are generally polymeric, e.g., a bulk polymer or polymer layer applied over a metal or paper support. As used herein, the term "substrate" refers generically to the ink-accepting layer beneath the radiation-sensitive layer 104, although the substrate may, in fact, include multiple layers (e.g., an oleophilic film laminated to an optional metal support, such as an aluminum sheet having a thickness of at least 0.001 inch, or an oleophilic coating over an optional paper support).

Substrate 102 desirably also exhibits high scattering with respect to imaging radiation. This allows full utilization of the radiation transmitted through overlying layers, as the scattering causes back-reflection into layer 104 and consequent increases in thermal efficiency. Polymers suitable for use in substrates according to the invention include, but are not limited to, polyesters (e.g., polyethylene terephthalate and polyethylene naphthalate), polycarbonates, polyurethane, acrylic polymers, polyamide polymers, phenolic polymers, polysulfones, polystyrene, and cellulose acetate. A preferred polymeric substrate is polyethylene terephthalate film, such as the polyester films available from DuPont-Teijin Films, Hopewell, Va. under the trademarks MYLAR and MELINEX, for example. Also suitable are the white polyester products from DuPont-Teijin such as MELINEX 927W, 928W 329, 329S, 331.

Polymeric substrates can be coated with a hard polymer transition layer to improve the mechanical strength and durability of the substrate and/or to alter the hydrophilicity or oleophilicity of the surface of the substrate. Ultraviolet- or EB-cured acrylate coatings, for example, are suitable for this purpose. Polymeric substrates can have thicknesses ranging from about 50 μm to about 500 μm or more, depending on the specific printing member application. For printing members in the form of rolls, thicknesses of about 200 μm are preferred. For printing members that include transition layers, polymer substrates having thicknesses of about 50 μm to about 100 μm are preferred.

Especially suitable substrates include polyethylene terephthalate, polyethylene naphthalate and polyester laminated to an aluminum sheet. Substrates may be coated with a subbing layer to improve adhesion to subsequently applied layers.

1.2 Layer 104

Layer 104 ablates in response to imaging radiation, typically near-IR radiation. In general, layer 104 has a cured resin phase consisting essentially of a melamine resin and a resole resin, the latter being present in an amount ranging from 0% to 28% by weight of dry film. A near-IR absorber—typically a dye—is dispersed within the cured resin phase.

Suitable melamine resins include methylated, low-methylol, high-imino melamine materials. For example CYMEL cross-linkers from Cytek Industries, Inc., especially CYMEL 385, CYMEL 328, CYMEL 327, CYMEL 325 and CYMEL 323, may be employed. Melamine self-crosslinking or crosslinking with a resole resin, if present, may be facilitated by a sulfonic acid catalyst, typically a p-toluenesulfonic acid catalyst.

If the melamine component has a solution viscosity of 7000 to 15,000 centipoises at 23° C., and especially 8000 to 10,000 centipoises, and most especially 9000 centipoises, then the p-toluenesulfonic acid catalyst is desirably present at 1.5% or less by weight of dry film, especially 1.2% or less, most especially from about 1.2% to 0.45%, but not lower than 0.35%. If the melamine cross-linker has solution viscosity 1000 to 1600 centipoises at 23° C., especially 1100 to 1300 centipoises, and most especially 1100 centipoise, then the p-toluenesulfonic acid catalyst is desirably present at 6% or less by weight of dry film, especially 4.8% or less, most especially from about 4.8 to 1.8%, but not lower than 1.4%.

It appears that the polymeric matrix of layer 104 will not tolerate addition of co-resin together with the melamine, other than the limited amount of resole resin described above. For example, when polyvinylbutyral, phenolic resin or resole resin (in this case, at amounts greater than 28% by weight of dry film) is added into the composition, poor printing-plate durability and/or poor sensitivity result. In addition, the amount of resole added as a co-resin limits the amount of catalyst that can be used to make successful plates. For example, when the melamine resin has viscosity of 9000 centipoises and the matrix includes no resole, then the amount x of catalyst may be in the range $0.35\% < x < 1.5\%$ by dry weight of film. If resole is added at 5%, however, then the acceptable range of catalyst level narrows to $0.35\% < x < 1.2\%$. If resole is used at 15%, then the range narrows to $0.35\% < x < 1\%$. Finally, if resole is used at 25%, then the range narrows to $0.35\% < x < 0.7\%$. In addition, when the melamine resin has a viscosity of 1100 centipoises and the matrix includes no resole, then the amount x of catalyst may be in the range $1.4\% < x < 6\%$ by weight of dry film. If resole is added at 5%, then the acceptable range of catalyst narrows to $1.4\% < x < 4.8\%$. If resole is used at 15%, then the acceptable range of catalyst narrows to $1.4\% < x < 4\%$. Finally, if resole is used at 25%, then the acceptable range of catalyst narrows to $1.4\% < x < 2.8\%$.

Layer 104 desirably exhibits water compatibility following ablation. When layer 104 is only partially ablated, it is either (a) sufficiently water-compatible to be fully removed during cleaning, or (b) oleophilic if some of the layer remains even after cleaning. This layer should exhibit good adhesion to substrate 102, and resistance to age-related degradation is also desirable. Typically, layer 104 is cured and dried at 220 to 320° F., and especially 240 to 280° F. (i.e., approximately 104 to 160° C., especially 115 to 137° C.).

For proper printing performance following mechanical cleaning, imaging layers having dry coating weights from 0.3 to 0.5 g/m$^2$, and especially 0.5 g/m$^2$, are preferred. Because the imaging layer is oleophilic it need not be fully removed after machine cleaning.

In various embodiments, ablatability is achieved at a fluence of 195 mJ/cm$^2$ or less, and more preferably at a fluence of 175 mJ/cm$^2$ or less. The ablation threshold is dictated primarily by layer thickness and the loading level and efficiency of the absorber. In the embodiments described herein, the absorbing dye is present at a loading level ranging from 20 to 30%.

1.3 Silicone Layer 106

The topmost layer participates in printing and provides the requisite lithographic affinity difference with respect to substrate 102; in particular, layer 106 is oleophobic and suitable for dry printing. In addition, the topmost layer 106 may help to control the imaging process by modifying the heat dissipation characteristics of the printing member at the air-imaging layer interface.

Typically, layer 106 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer. Silicone polymers are typically prepared by cross-linking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

The silicone layer may have a dry coating weight of, for example, 0.5 to 2.5 g/m$^2$, with the range 1 to 2.5 g/m$^2$ being particularly preferred for typical commercial applications.

1.4 Optional Secondary Imaging Layer 108

Figure 1B:
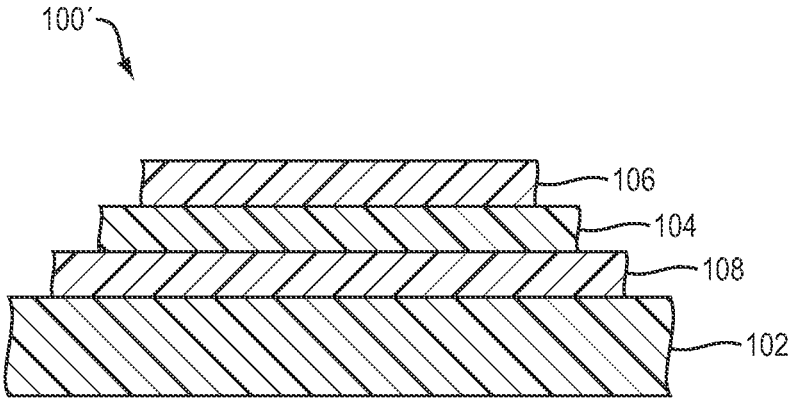

With reference to FIG. 1B, some embodiments 100' include an additional polymeric imaging layer 108 having an imaging pigment dispersed therein. Layer 108 can be any polymer capable of stably retaining, at the applied thickness, the IR-absorptive pigment dispersion (generally carbon black) adequate to cause ablation of the layer in response to an imaging pulse; and of exhibiting water compatibility following ablation. Furthermore, in embodiments where layer 108 is only partially ablated, it is either (a) sufficiently water-compatible to be fully removed during cleaning, or (b) oleophilic if some of layer remains even after cleaning. It is found that the carbon black enhances, or even confers, the desired water compatibility of layer 108 or the ablation debris thereof. Layer 108 should exhibit good adhesion to the overlying layer 104, and resistance to age-related degradation may also be considered.

In general, pigment loading levels are no greater than 20% or 25%, and the coating is applied at a dry weight of about 0.3 g/m$^2$. A typical composition for layer 108 includes or consists essentially of up to 25% carbon black, 60 to 90% resole resin (especially 70 to 80%), up to 20% melamine resin (usually about 10%), less than 5% catalyst and less than 2% surfactant/leveling agent.

2. Imaging of Printing Plates

Imaging of the printing member 100, 100' may take place directly on a press, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 33,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion. The imaging apparatus can be configured as a flatbed recorder or as a drum recorder, with the lithographic plate blank mounted to the interior or exterior cylindrical surface of the drum.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate. In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Examples of useful imaging devices include models of the MAGNUS and TRENDSETTER imagesetters (available from Eastman Kodak Company) that utilize laser diodes emitting near-IR radiation at a wavelength of about 830 nm. Other suitable exposure units include the CRESCENT 42T Platesetter (operating at a wavelength of 1064 nm, available from Gerber Scientific, Chicago, Ill.) and the SCREEN PLATERITE 4300 series or 8600 series plate-setter (available from Screen, Chicago, Ill.).

Following imaging, the printing member is subjected to an aqueous liquid to remove debris where the printing member received imaging radiation, thereby creating an imagewise pattern on the printing member. The aqueous liquid may consist essentially of water, e.g., it may be plain tap water. Alternatively, the aqueous liquid may comprise water and a component that eases the removal of silicone and ablation debris, facilitating faster and more efficient cleaning. The aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant and/or may be heated to a temperature greater than about 80° F.

In accordance with the present invention, machine cleaning takes advantage of the preferred imaging-layer coating weights. Preferred processing machines utilize warm water as a cleaning agent applied by spraying onto the plate (as opposed to immersion). Suitable examples include the Konings Plate Washer, type KP 650/860 S-CH (Konings GmbH, D-41751, Viersen, Germany) which has two rotary, oscillating brush rollers in the cleaning section), the AS-34 Plate Processor (NES Worldwide Inc., Westfield, Mass., which has three rotary, oscillating brush rollers in the cleaner section), and the Presstek WPP85/SC850 Plate Washer (NES Worldwide Inc., which has two rotary brush rollers).

EXAMPLES

Comparative Examples C1-C4

These examples involve negative-working waterless printing plates that include an oleophobic silicone layer, disposed on an imaging layer comprising an IR-absorbing dye and a polymer disposed on a polyester substrate. A preferred substrate is a 175 μm white polyester film sold by DuPont Teijin Films (Hopewell, Va.) labeled MELINEX 331. This is an opaque white film pretreated on one side to promote adhesion to solvent-based coatings.

An exemplary formulation for the IR-absorbing imaging layer is as follows:

| Components | Parts by Weight |
|---|---|
| Cymel 385 | 3.43 |
| S0094 NIR Dye | 0.78 |
| Cycat 4040 | 0.08 |
| BYK 307 | 0.06 |
| Dowanol PM | 95.65 |

CYMEL 385 is a methylated, low-methylol, high-imino melamine resin supplied as an 80% solids mix with water by Cytek industries, Inc. (West Paterson, N.J.). This sample has viscosity of 1200 centipoises at 23° C. CYCAT 4040 is a general purpose, p-toluenesulfonic acid catalyst supplied as a 40% solution in isopropanol by Cytek Industries, Inc. BYK 307 is a polyether modified polydimethylsiloxane surfactant supplied by BYK Chemie (Wallingford, Conn.). The solvent, DOWANOL PM, is propylene glycol methyl ether available from the Dow Chemical Company (Midland, Mich.). 50094 is a cyanine near IR dye manufactured by FEW Chemicals GmbH (Bitterfeld-Wolfen, Germany), which has a reported coefficient of absorption of $2.4\times10^5$ L/mol-cm at the maximum absorption wavelength, $\lambda_{max}$, of about 813 nm (measured in methyl ethyl ketone (MEK) solution). This dye exhibits very good solubility in the preferred solvent, DOWANOL PM, used in the formulations described herein. The formulation given above produces dry films containing 18% by weight of dye.

The coating solution was applied to the polyester substrate using a wire-round rod and then dried and cured at 138° C. (measured on the substrate) to produce dried coatings of about 0.5 g/m$^2$ and 0.9 g/m$^2$. The coat weight was measured gravimetrically on samples prepared with a formulation without catalyst. Drying and curing were carried out on a belt conveyor oven, SPC Mini EV 48/121, manufactured by Wisconsin Oven Corporation (East Troy, Wis.). The conveyor was operated at a speed of 3.2 feet/minute, which gives a dwell time of about 40 seconds in the air-heated zone of the oven. The actual temperatures on the polymer substrate were measured with calibrated temperature strips.

The oleophobic silicone top layer of the plate members was subsequently disposed on the dried and cured imaging layer using the formulation given below. The silicone layer exhibits a highly crosslinked network structure produced by the addition or hydrosilylation reaction between the vinyl groups (SiVi) of vinyl-terminated functional silicones and the silyl (SiH) groups of trimethylsiloxy-terminated poly(hydrogen methyl siloxane) crosslinker, in the presence of a Pt catalyst complex and an inhibitor.

| Component | Parts |
|---|---|
| PLY-3 7500P | 12.40 |
| DC Syl Off 7367 Crosslinker | 0.53 |
| CPC 072 Pt Catalyst | 0.17 |
| Heptane | 86.9 |

The PLY-3 7500P is an end-terminated vinyl functional silicone resin, with average molecular weight 62,700 g/mol, supplied by Nusil Silicone Technologies (Charlotte, N.C.). The DC SYL OFF 7367 is a trimethylsiloxy-terminated poly (hydrogen methylsiloxane) crosslinker manufactured by Dow Corning Silicones (Midland, Mich.) which is supplied as a 100% solids solution containing about 30% 1-ethynylcyclohexane [C═H—CH$(CH_2)_5$], which functions as catalyst inhibitor. The CPC 072 is a 1,3 diethyenyl-1,1,3,3-tetramethyldisiloxane Pt complex catalyst, manufactured by Umicore Precious Metals (South Plainfield, N.J.), which is supplied as a 3% xylene solution. The formulation solvent, heptane, is supplied by Houghton Chemicals (Allston, Mass.).

The silicone formulation was applied to the polymer imaging layers with a wire-round rod, then dried and cured at 150° C. (measured on the substrate) to produce uniform silicone coatings of 1.8 g/m$^2$ (gravimetric determination). The printing members were evaluated as follows to assess solvent resistance, environmental stability, and imaging sensitivity.

1. Plates stored at ambient conditions were tested by assessing solvent resistance with MEK. An MEK resistance test was conducted on pieces (~20 cm length) of the plate samples by applying, in a reciprocating mode at a five-pound load, double-rubs with a cotton towel saturated with MEK. The cycle was repeated to the point of visual evidence failure: marring of the surface or loss of silicone adhesion. To pass this test, the plates should resist more than 10 cycles of the test without showing signs of failure.

2. Fresh plate samples that passed the MEK resistance test (more than 10 MEK rubs) were exposed to accelerated aging conditions to determine their environmental stability. For this purpose, the MEK resistance test was repeated on samples that have been exposed to high temperature and humidity conditions (18 hours in an environmental chamber operated at 80° C. and 75% relative humidity.) To pass this test, aged samples withstood more than five cycles of the MEK resistance test (more than five MEK rubs) without showing signs of failure. All of the printing member passed the tape adhesion test and exhibited very good MEK resistance (MEK rubs between 25 and 50 cycles) after being exposed to the accelerated aging conditions.

3. Plate precursors were imaged on a KODAK TRENDSETTER image-setter (operating at a wavelength of 830 nm, available from Eastman Kodak Company). Sensitivity information was obtained from the evaluation of different imaging patterns (solid screen, 3×3, and 2×2 patterns) run at increasing power levels at a constant drum speed of 150 rpm. The output power of the laser was varied from 8 W up to 15 W at increments of one watt, which corresponds to infrared imaging radiation having fluences of 130, 147, 163, 179, 195, 210, 228, up to 240 mJ/cm$^2$ at the plane of the plate, respectively.

The final printing members were then produced by processing or cleaning of the imaged plate precursor on automatic plate cleaners to remove the loosened silicone debris left on the exposed areas of the imaged plate. This step was carried out on the following commercial automatic plate cleaners:

1. The PRESSTEK AS 34 plate washer, manufactured by NES Worldwide Inc. (Westfield, Mass.). In this machine, the plates are cleaned with warm tap water (~35° C.) by means of rotary brush rollers. The washer includes a Cleaner Section where the plates are cleaned by presoak, spray agitation, and three rotary, oscillating brush rollers.

2. The KP 650/860 S-CH plate washer from Konings (Viersen, Germany) in which the plates are cleaned with warm water (32° C.) with the help of two rotary, oscillating brush rollers in the cleaning section.

The degree of plate sensitivity was ascertained from print sheets obtained by running the cleaned plates on a GTO Heidelberg press using black ink (Aqualess Ultra Black MZ waterless ink, Toyo Ink America LLC, Addison, Ill.) and uncoated stock (Williamsburg Plus Offset Smooth, 60 lb white, item no. 05327, International Paper, Memphis, Tenn.). The samples were run for at least 200 impressions. The sensitivity of the plate embodiments is defined as the power required to yield sheets with well-defined, high-resolution 2×2 patterns. Examples requiring fluence levels equal or higher than 195 mJ/cm$^2$ to print the 2×2 patterns are classified as non-cleanable.

The following table gives information on the imaging and cleaning performance of the printing members produced on the different plate cleaners:

| Example | Melamine Layer Coat Weight (g/m$^2$) | Cleaning | Sensitivity (mJ/cm$^2$) |
|---|---|---|---|
| Example C1 | 0.5 | AS34 | 212 |
| Example C2 | 0.5 | Konings | 195 |
| Example C3 | 0.9 | AS34 | 204 |
| Example C4 | 0.9 | Konings | 204 |

Machine processing of these plate precursors fails to yield printing plates with acceptable sensitivity and/or cleaning performance; these plates require imaging at fluences equal or higher than 195 mJ/cm$^2$ to yield high-resolution prints.

Examples 1 and 2

These examples involve waterless printing plates having thin melamine imaging layers with concentrations of the NIR dye higher than that used in Example C1. The imaging layer formulations given below were disposed on the same polyester substrate described in Examples C1-C4.

| | Parts by Weight | |
|---|---|---|
| Components | Example 1 | Example 2 |
| Cymel 385 | 3.13 | 2.91 |
| S0094 NIR Dye | 1.09 | 1.31 |
| Cycat 4040 | 0.08 | 0.08 |
| BYK 307 | 0.06 | 0.06 |
| Dowanol PM | 95.65 | 95.65 |

The wet coatings were dried and cured at 138° C. (measured on the substrate) using the oven and conditions described above to produce dried coatings with a coat weight of 0.5 g/m$^2$, containing 25 and 30 parts per hundred (by weight) of NIR dye, respectively. A silicone layer of same composition and thickness as in previous examples was disposed on the dried/cured imaging layer and dried cured at 150° C. (measured on the substrate) as described above.

Printing plates were produced by imaging on the KODAK TRENDSETTER image setter and machine-cleaning on the PRESSTEK AS34 plate washer and the corresponding imaging sensitivities were determined using the same procedure described above. The following table summarizes the estimated plate sensitivities:

| Example | NIR Dye (Parts by Weight of Dry Melamine Layer) | Sensitivity (mJ/cm$^2$) |
|---|---|---|
| Example 1 | 25 | 185 |
| Example 2 | 30 | 163 |

Evaluation of the print data showed that the plate precursors of these examples yield high-resolution prints when imaged at fluences below 195 mJ/cm$^2$. The sensitivity of these printing members is higher than that of Example C1, which uses a melamine layer with lower dye levels. In addition, the imaging speed also improves proportionally with increasing dye levels.

Example 3

This example involves a waterless printing plate member having the same composition and structure as that of Example 1. It was prepared by cleaning on the Konings plate washer as in Example C2. This cleaning procedure also yields a high-sensitivity plate with suitable performance characteristics. The plate produces high-resolution patterns at a fluence of 147 mJ/cm$^2$, which is considerably lower than that required for Example C2 (the melamine imaging layer of which has a lower concentration of the S0094 NIR absorbing dye).

Examples 4 and 5

These examples describe waterless printing plates built having very thin (<0.5 g/m$^2$) melamine imaging layers with NIR dye concentrations similar to those used in Examples 1 and 2.

The imaging layer formulation was applied to the polyester substrate using wire-round rods of a narrower wire diameter than that used in the earlier examples. The wet coatings were dried and cured at 138° C. (measured on the substrate) using the oven and conditions described above to produce dried coatings of coat weight of 0.3 g/m$^2$. The latter was subsequently coated with the same silicone layer used in previous examples.

Automatic cleaning on the AS34 plate washer described in earlier examples produced the final printing members. The imaging sensitivities of these plate members are:

| Example | NIR Dye (Parts by Weight of Dry Melamine Layer) | Sensitivity (mJ/cm$^2$) |
|---|---|---|
| Example 4 | 25 | 185 |
| Example 5 | 30 | 171 |

The thin imaging layers with high dye levels yielded printing members that exhibit suitable imaging/cleaning performance. As in Examples 1 and 2, the sensitivity of these printing plates also improves with increasing dye levels.

Although the present invention has been described with reference to specific details, it is not intended that such details should be regarded as limitations upon the scope of the invention, except as and to the extent that they are included in the accompanying claims.

What is claimed is:

1. A method of imaging a printing member, the method comprising the steps of:

(a) providing a printing member comprising (i) an oleophilic, polymeric first layer;

(ii) disposed over the first layer, an oleophilic imaging layer having (A) a single crosslinked polymer network consisting essentially of a melamine component and a resole component, the resole component being present in an amount ranging from 0% to 28% by weight of dry film, wherein the single crosslinked polymer network is the only crosslinked polymer network in the oleophilic imaging layer, (B) dispersed within the imaging layer, a near-IR absorber present in an amount ranging from 20% to 30% by weight of dry film, and (C) a dry coating weight of not more than 0.5 g/m$^2$; and (iii) disposed over the imaging layer, an oleophobic third layer;

(b) exposing the printing member to imaging radiation in an imagewise pattern, the imaging radiation at least partially ablating the imaging layer where exposed; and (c) subjecting the printing member to machine cleaning to remove the third layer and at least a portion of the imaging layer where the printing member received imaging radiation, thereby creating an imagewise pattern on the printing member.

2. The method of claim 1, wherein the imaging radiation has a fluence not exceeding 195 mJ/cm$^2$.

3. The method of claim 1, wherein the machine cleaning is spray-on cleaning.

4. The method of claim 1, wherein the machine cleaning is carried out using oscillating brush rollers.

5. The method of claim 1, wherein the oleophilic first layer is polyester.

6. The method of claim 1, wherein the imaging layer contains no resole resin.

7. The method of claim 1, wherein the near-IR absorber consists essentially of a dye.

8. The method of claim 1, wherein the near-IR absorber constitutes no less than 25% of the imaging layer by weight of dry film.

9. The method of claim 1, wherein the melamine component constitutes no more than 88% of the imaging layer by weight.

10. The method of claim 1, wherein the melamine component is a methylated, low-methylol, high-imino melamine.

11. The method of claim 1, wherein the melamine component has a viscosity ranging from 7000 to 15,000 centipoises at 23° C.

12. The method of claim 1, wherein the melamine component has a viscosity ranging from and 1000 to 1600 centipoises at 23° C.

13. The method of claim 1, wherein the imaging layer has a dry coating weight of approximately 0.5 g/m$^2$.

14. The method of claim 1, wherein the machine cleaning comprises applying an aqueous liquid to the plate.

15. The method of claim 14, wherein the aqueous liquid is plain tap water.

16. The method of claim 14, wherein the aqueous liquid contains not more than 20% by weight of an organic solvent.

17. The method of claim 16 wherein the organic solvent comprises at least one of a glycol, benzyl alcohol or phenoxyethanol.

18. The method of claim 14 wherein the aqueous liquid comprises a surfactant.

19. The method of claim 14 wherein the aqueous liquid is heated to a temperature greater than 80° F.

20. A printing member comprising:

(a) an oleophilic, polymeric first layer;

(b) disposed over the first layer, an oleophilic imaging layer having (i) a single crosslinked polymer network consisting essentially of a melamine component and a resole component, the resole component being present in an amount ranging from 0% to 28% by weight of dry film, wherein the single crosslinked polymer network is the only crosslinked polymer network in the oleophilic resin composition, (ii) dispersed within the crosslinked polymer network, a near-IR absorber present in an amount ranging from 20% to 30% by weight of dry film, and (iii) a dry coating weight of not more than 0.5 g/m$^2$; and (c) disposed over the imaging layer, an oleophobic third layer.

21. The printing member of claim 20, wherein the oleophilic first layer is polyester.

22. The printing member of claim 20, wherein the imaging layer contains no resole resin.

23. The printing member of claim 20, wherein the near-IR absorber consists essentially of a dye.

24. The printing member of claim 20, wherein the near-IR absorber constitutes no less than 25% of the imaging layer by weight of dry film.

25. The printing member of claim 20, wherein the melamine component constitutes no more than 88% of the imaging layer by weight.

26. The printing member of claim 20, wherein the melamine component is a methylated, low-methylol, high-imino melamine.

27. The printing member of claim 20, wherein the melamine component has a viscosity ranging from 7000 to 15,000 centipoises at 23° C.

28. The printing member of claim 20, wherein the melamine component has a viscosity ranging from and 1000 to 1600 centipoises at 23° C.

29. The printing member of claim 20, wherein the imaging layer has a dry coating weight of approximately 0.5 $g/m^2$.

30. A method of making an ablation-type printing member, the method comprising the steps of:

(a) providing a precursor structure having a polymeric, oleophilic surface;

(b) coating, over the precursor structure, an oleophilic composition;

(c) curing the oleophilic composition to form a crosslinked polymer network;

(d) following step (c), coating, over the cured oleophilic composition, an oleophobic polymer composition; and (e) curing the oleophobic polymer composition, wherein the oleophilic composition has (A) a single crosslinked polymer network consisting essentially of a melamine component and a resole component, the resole component being present in an amount ranging from 0% to 28% by weight of dry film, wherein the single crosslinked polymer network is the only crosslinked polymer network in the oleophilic composition, (B) dispersed within the cured oleophilic composition, a near-IR absorber present in an amount ranging from 20% to 30% by weight of dry film, and (C) a dry coating weight of not more than 0.5 $g/m^2$.

31. The method of claim 30 wherein the resin composition is cured at a temperature ranging from 220 to 320° F.

32. The method of claim 30 wherein the resin composition is cured at a temperature ranging from 240 to 280° F.

* * * * *